US005667563A

United States Patent [19]

Silva, Jr.

[11] Patent Number: 5,667,563

[45] Date of Patent: Sep. 16, 1997

[54] AIR IONIZATION SYSTEM

[76] Inventor: John C. Silva, Jr., 8 Putnam Rd., Apt. #4, Ipswich, Mass. 01938

[21] Appl. No.: 501,892

[22] Filed: Jul. 13, 1995

[51] Int. Cl.[6] ..... B03C 3/14

[52] U.S. Cl. ..... 96/50; 55/279; 95/58; 96/63; 96/96; 96/97; 422/186.07; 422/186.15

[58] Field of Search ..... 96/97, 96, 62, 96/63, 52, 50, 16; 95/58; 55/279; 422/22, 122, 4, 5, 186.07, 186.15

[56] References Cited

U.S. PATENT DOCUMENTS

| | | | |
|---|---|---|---|
| 2,195,431 | 4/1940 | Shively et al. | 96/97 X |
| 2,639,781 | 5/1953 | Savitz | 96/62 |
| 2,841,242 | 7/1958 | Hall | 95/58 |
| 4,203,948 | 5/1980 | Brundbjerg | 96/16 X |
| 4,449,159 | 5/1984 | Schwab et al. | 96/97 X |
| 4,477,263 | 10/1984 | Shaver et al. | 96/97 X |
| 4,551,304 | 11/1985 | Holter et al. | 422/4 |
| 4,734,105 | 3/1988 | Eliasson et al. | 96/97 X |
| 4,842,829 | 6/1989 | Hirai et al. | 422/120 X |
| 5,334,238 | 8/1994 | Goodson et al. | 96/50 X |
| 5,456,741 | 10/1995 | Takhara et al. | 96/97 X |

FOREIGN PATENT DOCUMENTS

| | | | |
|---|---|---|---|
| 668707 | 6/1979 | U.S.S.R. | 96/97 |

*Primary Examiner*—Richard L. Chiesa
*Attorney, Agent, or Firm*—Donald J. Perreault

[57] ABSTRACT

An air ionization device for use in industrial, commercial or residential settings which includes a core section shaped to provide internal venturi action in order to force air outwardly from an ozone manifold. Air fins are provided at the front of the cabinet to prevent turbulence of air as it exits the cabinet. The device further includes electronics for providing controlled negative ozone and ionization output, and a 12 VDC power supply for operating system fans and relays. The device can operate as a master unit to control up to four slave units (i.e. up to five units on one system) for providing even distribution of ions and ozone over large industrial areas. In addition, various features are provided to allow for facile servicing of the device, including a purging hose mounted inside the core, removably replaceable ionization needles, and ozone relief holes positioned directly behind the ionization needles for constantly purging the needles and keeping them clean.

19 Claims, 5 Drawing Sheets

AIR IONIZATION SYSTEM

FIELD OF THE INVENTION

The present invention relates to an air ionization system for purifying air in a closed area.

BACKGROUND OF THE INVENTION

The presence of odors, dust, and other contaminants in some industrial settings has long been a concern to business owners. In certain industries where various odors and airborne particles are constantly generated, workers are constantly exposed to an unhealthy environment and products and equipment are constantly exposed to the damaging effects of these contaminants. To address these concerns, these industries have turned to various air purification systems. The main type of industrial air purification system currently in use is an air filtration system. Air filtration systems transport contaminated air through specially designed filters to trap the undesirable particles.

To date, however, air filtration systems have proven to be highly ineffective. This is primarily due to the fact that in order to filter contaminated air, the air must be physically transported from the area where the contamination is generated to the filtration device. During this process, contaminated air is inevitably drawn directly through areas where it causes the most damage. In addition, air purification systems have no real effect on the contaminated air as it is immediately generated. Thus, a worker using a grinding tool or the like, is immediately subjected to the airborne particles which may be breathed in, or which may settle on clothing, or in hair. Accordingly, these workers are commonly required to wear various filtering masks and protective clothing.

Moreover, typical air filtration systems require regular and extensive maintenance. The filters must be constantly changed in order to ensure proper operation of the system, and the used filters must be treated as contaminated waste. Accordingly, considerable expense is required for the services of maintenance personal, the cost of new filters, and the disposal of used filters. Also, since the contaminated air is transported through the filtration system, contaminants can build up on sensitive areas of the system thereby causing system failure.

In other commercial settings such as restaurants, hotels, gymnasiums, etc., the prime concern is with the odors resulting from various activities and from the release of various sprays, chemicals, weldings, or burnings in an enclosed area. Unpleasant odors are, obviously, not conducive to promoting customer satisfaction or employee well-being. For the same reasons discussed above, air filtration systems have not produced satisfactory results in eliminating odors in these settings. Thus, there has long been a need in industrial and commercial settings for an air purification system which would eliminate particles and odors without transporting them through sensitive areas to be filtered.

Residential air filtration systems naturally suffer from the same disadvantages. Accordingly, in recent years various air ionization devices have been developed for residential use. Air purification by ionization is an old concept which has only recently gained deserved attention. Residential air ionization systems are designed to negatively ionize contaminated air so that it will attract electrically positively charged contaminants thereby causing these contaminants attach to each other in mid-air and drop to the floor. In theory, by spreading a constant stream of negatively ionized air combined with a smaller percentage of positively ionized air over a room, undesirable particles are effectively prevented from becoming airborne at their source. Thus, these particles are never transported into areas where they can cause damage or discomfort.

In addition, recent studies indicate that air ionization devices can actually have a beneficial effect even in the total absence of air contamination. These findings stem from a recognition that the normal outside ion concentration of the atmosphere is approximately five positive ions to four negative ions. When this normal concentration is upset to contain an excess of positive ions, e.g. inside a building where the negative ions are attracted by ground thereby depleting them or by atmospheric conditions, living organisms experience an overall negative health effect. Under these conditions, people tend to become lethargic and complacent. However, an overdose of negative ions in the atmosphere tends to have the opposite effect on people; raising attentiveness and providing a general feeling of well-being.

Despite this, the prior art has not been successful in providing a device which takes advantage of all of the benefits of air ionization. Known air ionization systems are only capable of handling relatively small enclosed areas. Widespread industrial use of such systems has not been achieved. In addition, prior art devices have yet to reap the health benefits of generating high concentrations of negative ions.

Accordingly, there is a need in the art for an air ionization device that is suitable for industrial uses. Such a device must effectively prevent airborne particles from spreading about a closed area, and at the same time require facile and infrequent service. In addition, there is a need in the art for an air ionization device which recognizes and reaps the benefits of creating excess concentrations of negative ions without suffering performance deviations as a result of contamination.

OBJECTS OF THE INVENTION

Thus, it is an object of the present invention to provide a air ionization device which is suitable for industrial use.

Another object of the present invention to provide a air ionization device which meets the needs of large industrial areas.

Yet another object of the present invention is to provide an air ionization device which prevents air contaminants from becoming airborne and spreading into sensitive areas of the system electronics.

Still another object of the present invention is to provide an air ionization device which requires facile and infrequent service.

Still another object of the present invention is to provide an air ionization device which generates an adjustable excess of negative ions compared to positive ions thereby taking advantage of the health benefits associated with high negative ion concentrations.

Still another object of the present invention is to provide an air ionization device which generates a controlled amount of ozone thereby taking advantage of the purifying qualities of ozone.

These and other objects of the present invention will become apparent from a review of the description provided below.

SUMMARY OF THE INVENTION

The present invention involves an air ionization system for use in industrial, commercial or residential settings. In a preferred embodiment, the system includes an ionization unit for providing positive and negative high voltage direct current output to a plurality opposed pairs of ionization needle assemblies. The positive high voltage direct current output of the ionization unit is connected to a first number the opposed pairs ionization needle assemblies, and the negative high voltage direct current output is connected to a second number of the opposed pairs of ionization needle assemblies. Advantageously, the negative output of the unit is connected to more pairs of ionization needle assemblies than the positive output. In a preferred embodiment, the negative output is connected to 80% of the pairs of needles. This arrangement provides for an overall negative ionization effect.

The ionization needle assemblies preferably include an insulating base section, a wire inserted into a bottom of the base section, and a connector clip electrically fastened to a conductor of the wire. The ionization needle is removably inserted into the connector clip and extends axially outward from the base section.

In addition, the system preferably includes said ozone generation unit which includes a rectifier, e.g. a half-wave bridge rectifier, for creating a high voltage negative direct current output from an alternating current input. Ozone generation plates are connected between the high voltage direct current output and ground, and create negative ozone from air passing by the ozone generation plates. This arrangement allows for the generation of controlled negative ozone in addition the negative ionization provided by the ionization unit.

In one embodiment, the ozone generation unit may include an ozone cartridge adapted to receive the ozone generation plates. The ozone cartridge includes at least one set of opposed slots for removably receiving the ozone generation plate, and a terminal for electrically connecting the ozone generation plate with an output of the ozone generation unit. A projection is preferably formed on the ozone cartridge for receiving a connector attached to the ozone generation plate to thereby removably fix the ozone generation plate within the cartridge.

Another aspect of the invention involves a unique low voltage control unit. The low voltage control unit includes a transformer for creating a 12 VDC output from an alternating current input. The 12 VDC output is provided as an input to operate at least one component of the system, e.g. a fan, through at least one 12 VDC relay. This allows for use of reliable, inexpensive, and generally available automotive fans and relays in the system.

The system may also include a core designed to create a Venturi effect for urging air outwardly from a middle section. The core has an interior surface defining a first wide opening adjacent the front of the core, a narrow middle opening at a middle of the core, and a second wide opening adjacent a back of the core. The middle section provides a region of air pressure differential compared to the first and second wide openings to thereby urge air outwardly from the middle section. In a preferred embodiment, the core includes holes adjacent at least one of the ionization needles. This allows the negative ozone to pass directly over at least one ionization needle immediately as it enters the core thereby cleaning contaminants from the needles.

The core may also include at least one pair of opposed slots formed in the core between the opposed pairs of ionization needle assemblies. At least one percentage divider plate is adapted to be removably received by the opposed slots for isolating a first set of the opposed pairs of ionization needle assemblies from a second set of the opposed pairs of ionization needle assemblies.

Preferably, the core also includes at least one set aligned angled slots formed in a top and bottom of said core adjacent a front of said core. The slots are adapted to receive an air distribution fin for reducing turbulence created by air exiting the system from the front of the core.

The system also preferably includes a terminal strip for connecting the 12 VDC output of the low voltage control unit to at least one additional air ionization system for operating at least one component of said additional air ionization system. This allows for operation of the unit as a master unit to run additional slave units. Preferably the master unit and the slave units share a common control panel for controlling operation from a common control.

Finally, a the system includes a purging system on the interior of the core for cleaning contaminants from the interior surfaces. The purging system includes at least one purging hose connected to a compressed air source. The purging hose extends into the core and is adapted to move within the core when compressed air is forced through the purging hose to thereby clean contaminants from an interior surface of the core.

BRIEF DESCRIPTION OF THE DRAWING

A preferred embodiment of the invention is described below with reference to the following figures wherein like numerals represent like parts.

DETAILED DESCRIPTION OF THE INVENTION

To facilitate detailed description of the invention, the general operation of an air ionization device according to the invention will first be described broadly with reference to its main constituent parts. A detailed explanation of the various aspects of the invention will follow the broad operational description.

Figure 1:
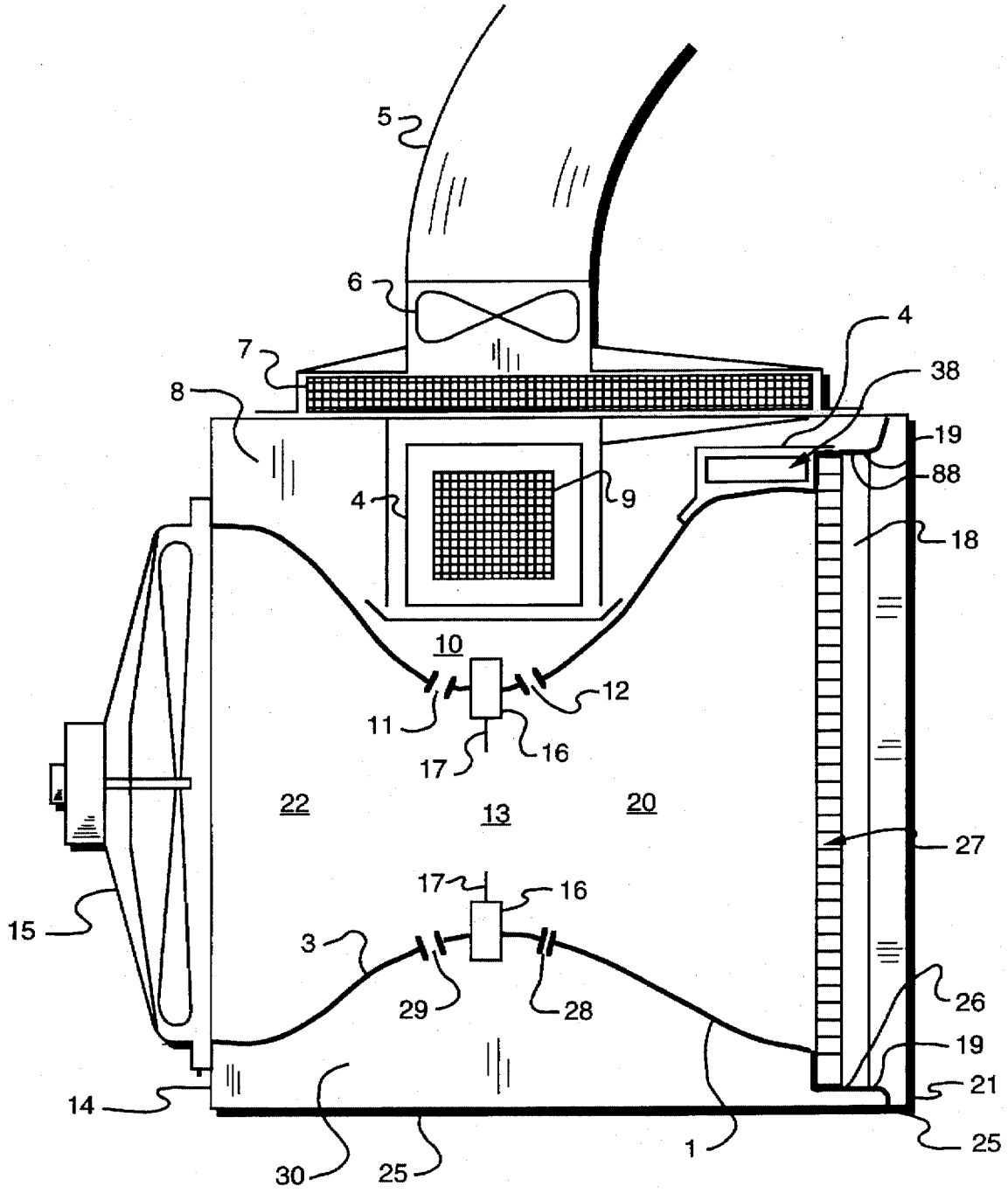
FIG. 1: is a side sectional view of a preferred embodiment of an air ionization device according to the present invention.
Figure 2:
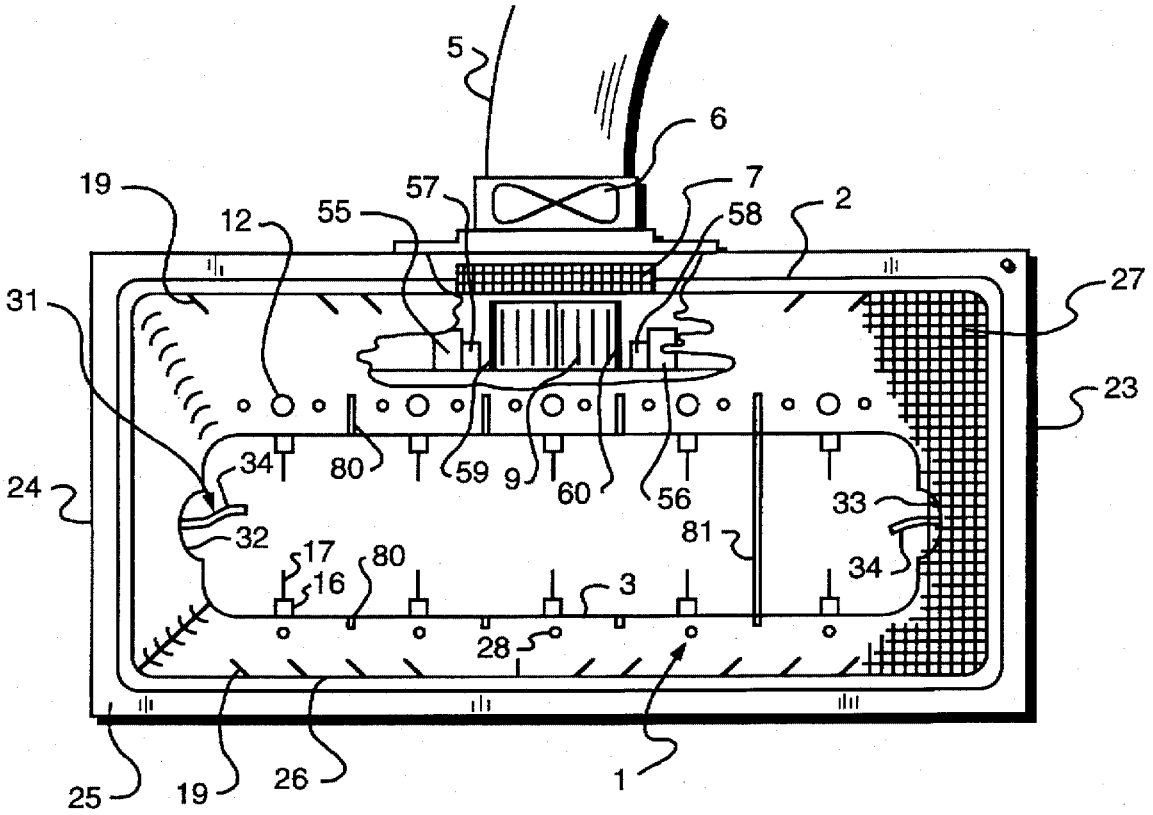
FIG. 2: is a front partial sectional view of a preferred embodiment of an air ionization device according to the present invention.

Referring to FIGS. 1 and 2, a preferred air ionization device according to the present invention comprises a core assembly 1 having a substantially rectangular exterior surface 2 and a contoured interior surface 3. Mounted onto the core assembly are electronics 4 for generating controlled negative ozone and for ionizing air, negatively and positively, as it passes through the core. Air is obtained from outside of the building through appropriate duct work 5 into the top of the device by action of a fan 6 which also acts to cool the system electronics 4. Before entering the core assembly, the outside air passes through a washable filter 7 and into chamber 8 formed to the exterior surface of the core and the device housing 25. The outside air enters the interior of the core assembly only after passing through and between several ozone generation plates 9. These ozone generation plates are charged at high voltages, e.g. −5000 VDC, by the ozone generation electronics to modify the ion concentration of the incoming outside air. Thus, a controlled negative ozone concentration is passed into the interior of the core assembly through a distribution manifold 10 and exits through holes 11, 12 in the relatively low pressure narrow middle Venturi section 13 of the core assembly.

At the same time, inside air is drawn through the back of the assembly 14 by preferably two fans 15. The inside air is forced through the middle section 13 creating a Venturi action created by the interior shape of the core and the force provided by the fans. As it passes through the middle section, the air moves between several ion needle assemblies 16 mounted along the core at the top and bottom of the middle section 13. These needle assemblies comprise a relatively fine needle conductor 17 mounted within an insulated base. The needle conductors are charged at high voltages to controllably ionize air as it passes through the middle section.

After passing by the ionization needle assemblies 16, the inside air is forced out of the device along with the controlled ozone into the area to be treated by the system. As it passes out of the cabinet, however, the ionized inside air and the controlled ozone is directed outwardly away from the cabinet by a section of removable fanned fins 18. These fins are preferably of a solid construction arranged in slots 19 defined on the surface 88 of the core. By directing the air as it exits the cabinets, these fins provide the valuable function of reducing air turbulence at the exterior of the cabinet. This prevents the possibility that particles or contaminants which have settled near the front of the cabinet will be stirred up by the exiting air and caused to settle in another position.

Referring still to FIGS. 1 and 2, the design of the core assembly will now be discussed in further detail. The interior surface 3 of the core assembly is designed to provide a Venturi effect and defines a first relatively wide section 20 adjacent the front 21 of the device which converges, preferably uniformly, to a relatively narrow middle section 13. A second relatively wide section 22 adjacent the back 14 of the device also converges, preferably uniformly, to the relatively narrow middle section 13.

The relatively narrow middle section 13 provides a region of low air pressure compared to the relatively wide sections 20,22 at the front and back of the device. In view of low air pressure present in the middle section 13, air which is present inside the device is urged outwardly toward regions of higher pressure at the exterior of the device. Accordingly, there is a beneficial Venturi effect creating a tendency for any air which enters the cabinet through the top to exit the cabinet and combine with the air in the room.

The core assembly is preferably molded using fiberglass and is of unitary construction. In the preferred embodiment, the core assembly has a rectangular exterior shape with solid ends 23,24 for supporting a stainless steel housing 25. In addition, an undercut 26 is formed at the top sides and bottom of the core front for mounting a grill 27. The grill 27 is provided for preventing foreign objects from entering the interior of the device while allowing free passage of air, and for preventing inadvertent contact with the high voltage needle assemblies which could cause injury.

Various holes are formed on the interior surface of the core to allow for appropriate air flow. Referring to FIG. 1., holes 11, 12 are located on either side of each ionization needle at the top of the middle section. The holes 11,12 allow for the controlled ozone to pass from the ozone distribution manifold 10 into the interior of the core. Advantageously, one of the holes 11 is located directly behind each ionization needle assembly 16. This configuration allows for constant purging of the ion needle assemblies 16.

Another set of holes 28, 29 are at the bottom of the interior surface of the core. These holes are preferably spaced from the ionization needles and are provided to allow air flow out of the bottom chamber 30 defined by the core and the housing 25. This allows for cooling of the system electronics by dissipation of generated heat, and constant purging of the bottom ion needle assemblies 16.

Another feature of the core assembly is the incorporation of a purging system 31. The purging system is defined by preferably two dimples 32, 33 formed on the sides of the core, one on each side. Each dimple has a center bore (not shown) to the exterior of the housing through which a small purging hose 34 is inserted. Preferably, the purging hose extends about 4" into the interior of the core and is about 0.25" in diameter. Periodic cleaning of contaminants from the interior surface of the device is achieved by forcing compressed air through the purging hoses 34. The compressed air can be derived from an external commercial compressor or through a bottled air source (not shown).

As the compressed air is forced through the hoses, the flexible purging hoses 34 are forced into rapid random movement against the interior of the core. This action, combined with the compressed air exiting from the ends of the purging hoses, causes the hoses to strike against the interior of the core thereby loosening contaminants and blowing them from the interior surface of the core. Once the contaminants are loosened from the core surfaces, they are blown out of the assembly by the system fans and ultimately settle on the floor.

Figure 3:
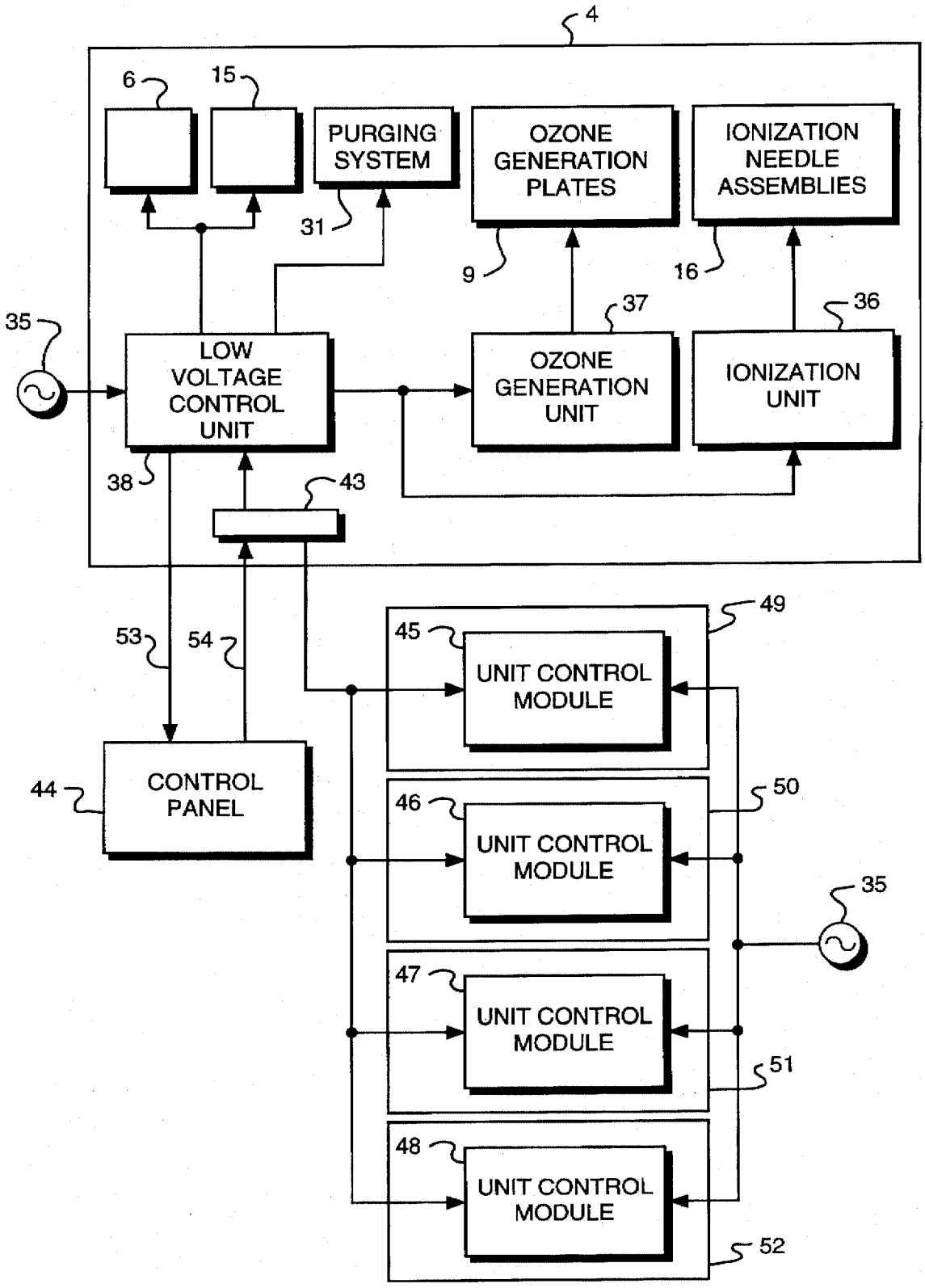
FIG. 3: is a block diagram of the system electronics for and optional connections for additional slave devices for ionization device according to the present invention.

Turning now to FIG. 3, the major components of the system electronics 4 will now be discussed in general terms with a more detailed description to follow. Generally, the device utilizes a 110 VAC input for operating three main units; an ionization unit 36, an ozone generation unit 37, and a low voltage control unit 38. The heart of the electronics comprises a low voltage control unit 38.

Through the operation of appropriate transformers, the 110 VAC input 35 is rectified in the low voltage unit to provide a ±12 VDC output. The 12 VDC output is used to operate the system fans 6, 15 as well as the purging systems 31. This provides the significant advantage of making possible the use of generally available reliable automotive fans and relays. Since automotive equipment is made to withstand severe conditions and is readily available at relatively low prices, provision of 12 VDC in the low voltage control unit makes the overall system more reliable at a reduced expense. In addition, other advantages are achieved which are directly related to the capacity to use automotive products, e.g. replacement parts are readily available, and fan speed can be easily adjusted.

In addition to generating a 12 VDC power source, the low voltage control unit routes the 110 VAC input to the other main system components, the ozone generation unit 37 and the ionization unit 36, the system fans 15,16, the purging systems 31. This routing is accomplished using 12 VDC relays within the low voltage control unit. These relays are connected to a system control panel 44 which allows for selective control of power to the system components.

Advantageously, the a twelve pole terminal strip 43 is also provided which facilitates connection of up to four additional ionization systems 49,50,51,52. Thus, the system has the capability for accommodating large industrial areas since up to five air ionization units according to the invention may be operated in simultaneous fashion. To accomplish this, the appropriate control panel switches are connected, through the terminal strip 43, to unit control modules 45,46,47,48 in each of the four additional units 49,50,51,52. Each unit control module contains six 12 VDC relays for selectively operating the system components of the ionization system in which it resides through the control panel 44.

A complete five unit system can operate on a single 20 amp service as each unit only requires about 2.75 amps to operate. The relays of low voltage control system are preferably wired to a the control panel by simple multi-wire telephone cables 53,54. The control panel controls ion and ozone generation, fan speed, the purging unit, the ion output, and the power to all of the connected units. Thus, when an adjustment is made on this control panel, all units on the system meet to that adjustment.

Figure 4:
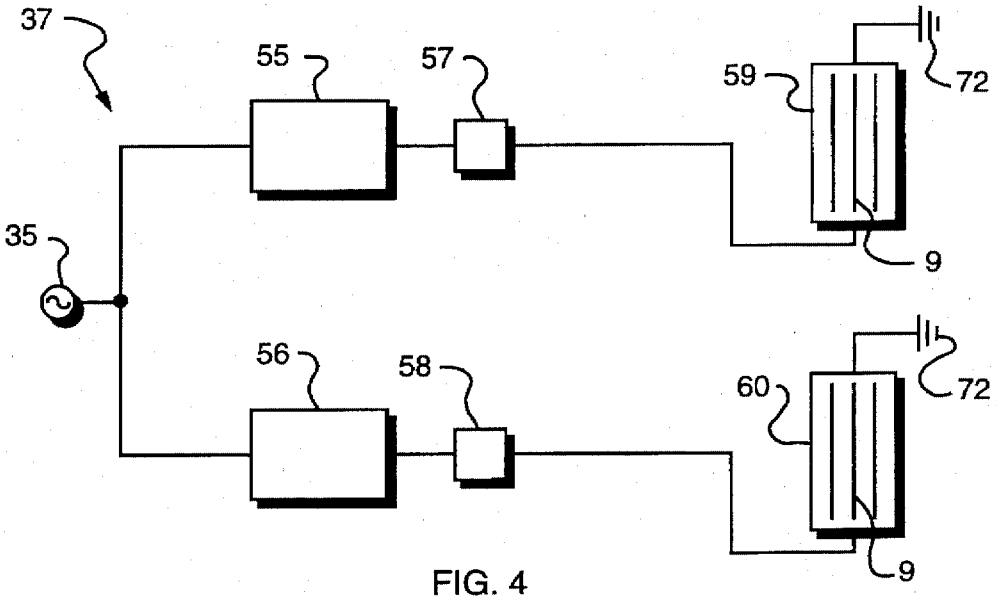
FIG. 4: is a block diagram of the main components of an ozone generation unit for an ionization device according to the present invention.

Turning now to FIG. 4, the main components of a preferred ozone generation unit 37 according to the invention includes high voltage transformers 55, 56 and two half-wave bridge rectifiers 57, 58. The 110 VAC input from the low voltage control module transformed via transformers to 5000 VAC and then rectified by half wave rectifiers 57,58 to provide a −5000 VDC output. The −5000 VDC output of each rectifier 57,58 is provided as an input to the ozone generation cartridges 59,60 which each contain preferably 3 ozone generation plates 9 for generating negative ozone.

As discussed above, ozone generation has been known for decades, yet no ozone generation system has yet been designed for taking advantage of the beneficial effects of outside filtered air, negative ions and negative ozone. By providing a rectified negative high voltage to the ozone generation plates, however, an ionization system according to the present invention reaps these benefits.

Figure 5:
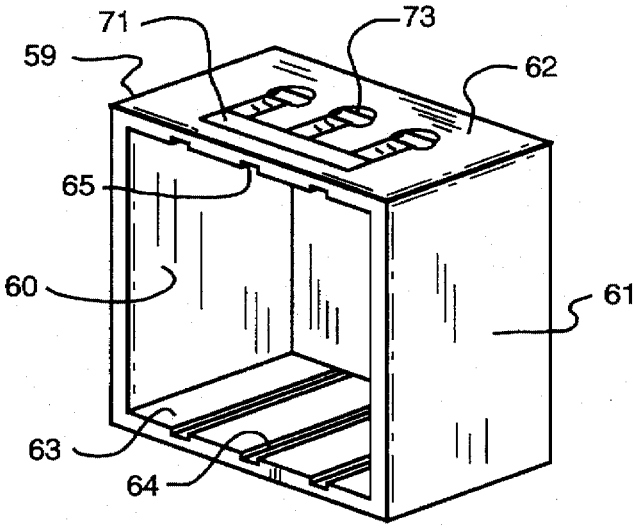
FIG. 5: is a front view of an ozone cartridge according to the present invention.

Another advantage of the present invention can be seen clearly with reference to FIG. 5 which shows the construction of an ozone cartridge 59 according to the present invention. Each ozone cartridge 59 is preferably unitary construction formed from an insulating material such as Lexan. The cartridge is preferably square including two walls 60,61, and a top 62 and bottom and 63. The inner surfaces of the top 62 and bottom 63 of the cartridges have three sets of opposing grooves 64,65 formed therein for receiving up to three ozone generation plates 9.

Figure 6:
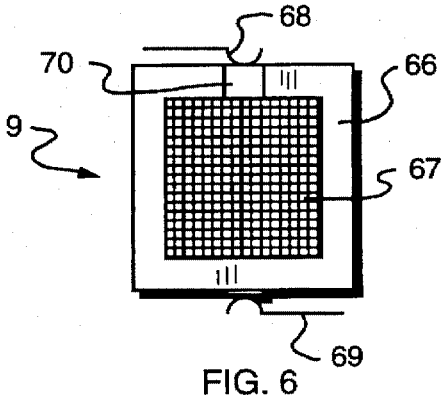
FIG. 6: is a front view of an ozone generation plate for use in connection with an ozone cartridge according to the present invention.

Referring also to FIG. 6, the ozone generation plates are inserted into the grooves 64,65. Each plate 9 comprises a 0.030" ceramic plate onto which a 10-mesh, 0.025" wire stainless steel mesh 67 is fixed using an epoxy. Attached to the top and bottom of each plate are spot welded connectors 68, 69 which serve to fix the plate within the ozone cartridge 59 and also serve to provide communication between the terminal strips on the top 71 and bottom (bottom strip not shown) of ozone cartridge 59 and the stainless steel mesh 67 of each ozone plate 9. The connector 68 at the top of the cartridge is fixed to a steel band 70 which is in direct electrical communication with the steel mesh 67. The connector 69 at the bottom of each ozone plate is ultimately connected to a system ground 72 as is shown in FIG. 4.

As the ozone plates 9 are slid into the opposing grooves 64, 65 of the ozone cartridge, the connectors 68,69 engage inward projections 73 formed into the top and bottom of the cartridge. Once fully inserted, the plates are in direct electrical communication with the terminal strips 71 to thereby facilitate connection of the −5000 VDC to the top of the plate through connector 68, and a ground connection to the bottom of the plate through connector 69.

This ozone cartridge construction provides a significant advantage in terms of servicing the overall ionization system. It is commonly known that the high voltages at which the ozone generation unit operates tend to cause deterioration of the plates and associated components. In conventional designs the plates were difficult to remove and the process was time consuming. However, according to the present invention, the plates may be easily inserted and removed from the cartridges for servicing or replacement.

Figure 7:
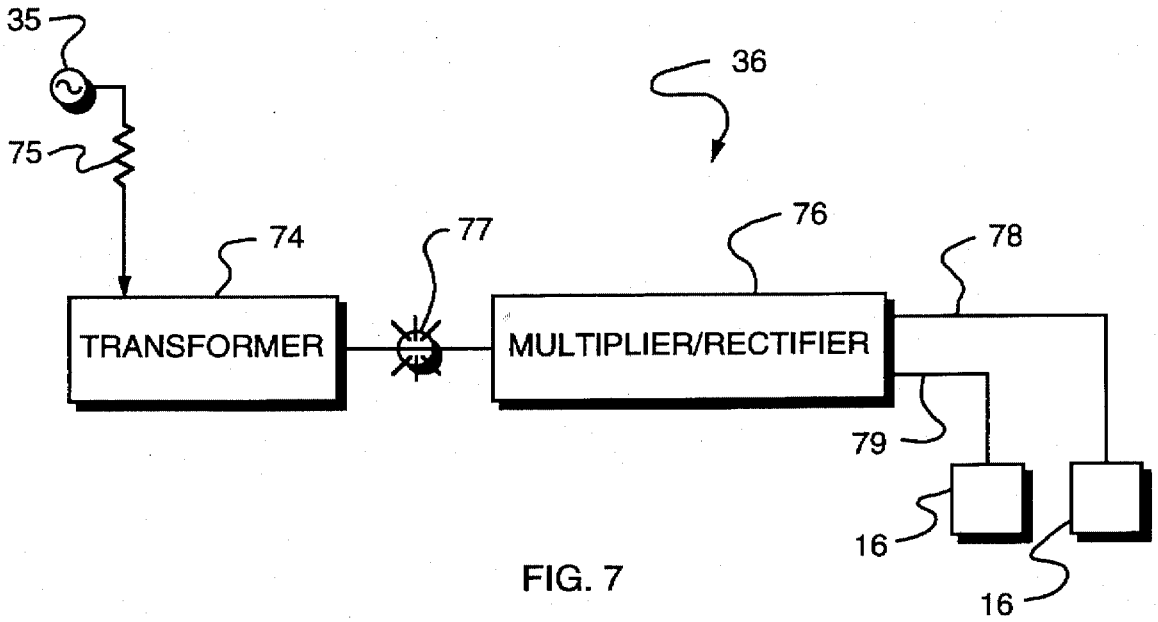
FIG. 7: is a block diagram of the main components of an ionization unit for an ionization device according to the present invention.

Referring now to FIG. 7, the main components of an ionization unit 36 according to the present invention will now be discussed. The 110 VAC input 35 provided to the ionization unit through the low voltage control module 38 (FIG. 3) is connected to a 10,000 VAC transformer 74 through a 500 ohm/100 watt resistor 75. The output of the transformer 74 preferably at 5000 VAC and is provided as the input to a common multiplier/rectifier circuit 76 across a spark gap 77. The spark gap is provided instead of a direct connection to allow for visual verification that the high voltage output is present and to prevent the multiplier 76 from feeding back into the transformer 74 and burning it out.

The multiplier 76 provides a DC output in the range from about ±50,000–80,000 VDC. The high voltage DC output of the multiplier is connected directly to the opposing pairs ionization needle assemblies 16 for ionizing air as it passes through the core of the device. In order to take advantage of the health benefits of providing an excess of negative ions for air purification, the positive output 78 of the multiplier is preferably connected to fewer needle assemblies 9 than is the negative output 79. In the preferred embodiment the negative output 79 is connected to 80% of the needle assemblies while the positive output is connected to 20% of the needle assemblies. This distribution, however, can be modified to provide any proportion of positively to negatively charged needle assemblies.

Turning again to FIG. 2, the core assembly includes divider plate slots 80 spaced between opposing pairs of needle assemblies 16. These slots 80 are adapted to receive a percentage divider plate 81 which is inserted into the core for purposes of separating the negatively charged needle assemblies from the positively charged needle assemblies. In the arrangement of FIG. 2, the divider plate separates four opposing pairs of needle assemblies which are preferably negatively charged from one opposing pair of needle assemblies which are preferably positively charged.

By separating the needle assemblies in this fashion, negatively ionized air is prevented from combining with positively ionized air within the core assembly. Instead, the negative and positive ions are forced out of the device and fanned out into the room by the fins 18. Thus, the ionized air is allowed to combine with contaminants in the room thereby purifying the air within the room.

Figure 8:
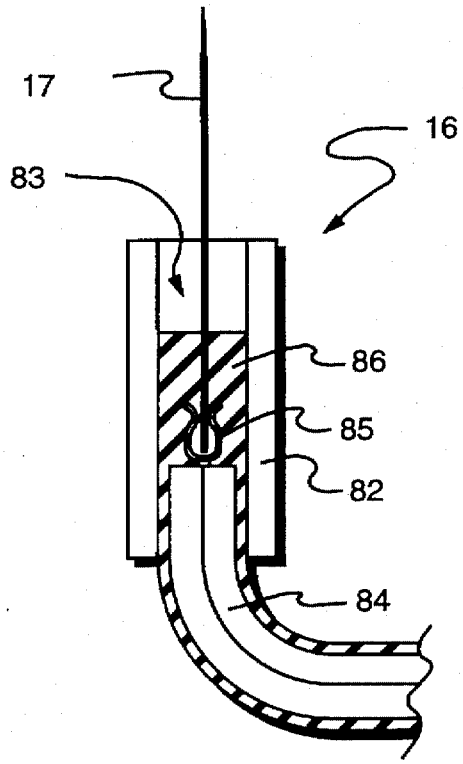
FIG. 8: is a front sectional view of an ionization needle assembly for an air ionization device according to the present invention.

A preferred embodiment of an ionization needle assembly 16 is shown in FIG. 8. The assembly 16 preferably includes a cylindrical ceramic base section 82 into which an insulator sleeve is inserted 83. A high voltage wire 84, e.g. copper core spark plug wire is inserted into one end of the assembly and connects the assembly to an output 78, 79 of the multiplier 76. A stainless steel connector clip 85 is electrically connected to the conductor of the wire 84 and a stainless steel ionization needle 17 is inserted into the connector clip 85 thereby electrically connecting the needle 17 to an output 78, 79 of the multiplier. Finally an insulating layer 86 of silicon rubber is inserted over the needle and connector clip to maintain the needle concentric with the ceramic base section 82.

Advantageously, the arrangement of FIG. 8 allows for facile servicing of the ionization needles which tend to require periodic replacement. With this arrangement, then ionization needle 17 can be removed from the assembly by simply pulling it loose from the connector clip 86. A new needle 17 can then be inserted into the connector clip 86 by inserting it through a hole left by the previous needle in the silicon layer 86.

Thus, according to the present invention there is provided an air ionization system which is adapted to reap the benefits of providing controlled ionization and controlled negative ozone for purifying the air within a large industrial space. The device according to the invention contains several features which allow for the facile servicing and reliable operation required of industrial use. The embodiments which have been described herein, however, are but some of the several which utilize this invention and are set forth here by way of illustration but not of limitation. It is obvious that many other embodiments which will be readily apparent to those skilled in the art may be made without departing materially from the spirit and scope of this invention.

What is claimed is:

1. An air ionization system comprising:

a core, an ionization unit mounted to said core for ionizing air passing through said core, said ionization unit providing positive and negative high voltage direct current output to a plurality of opposed pairs of ionization needle assemblies, said positive high voltage direct current output being connected to a first number of said opposed pairs of ionization needle assemblies, and said negative high voltage direct current output being connected to a second number of said opposed pairs of ionization needle assemblies;

an ozone generation unit mounted to said core for creating a high voltage output from an alternating current input; and at least one ozone generation plate connected between said high voltage output and ground, said ozone generation plate creating ozone in said core from air passing by said ozone generation plate, said ozone being directed out of said core with said ionized air.

2. An air ionization according to claim 1, said system further comprising:

a low voltage control unit, said low voltage control unit comprising a transformer for creating a 12 VDC output from an alternating current input, said 12 VDC output being provided as an input to operate at least one component of said air ionization system.

3. An air ionization system according to claim 2 wherein said at least one component is a fan.

4. An air ionization system according to claim 2 wherein said low voltage control unit further comprises at least one 12 VDC relay for controlling said input to operate said at least one component.

5. An air ionization system according to claim 2 wherein said 12 VDC output is connected to a terminal strip, said terminal strip connecting said 12 VDC output as an input to at least one additional air ionization system for operating at least one component of said additional air ionization system.

6. An air ionization system according to claim 5 wherein said system and said at least one additional system share a common control panel for controlling operation of said system and said at least one additional system.

7. An air ionization system according to claim 1, wherein said core comprises:

an interior surface defining a first wide opening adjacent a front of said core, a narrow middle opening at a middle of said core, and a second wide opening adjacent a back of said core, said middle section providing a region of air pressure differential compared to said first and second wide openings to thereby urge air outwardly from said middle section.

8. An air ionization system according to claim 1, wherein said ionization needles are mounted on said core, said core comprising an opening adjacent at least one of said ionization needles, said opening allowing said ozone to pass directly over said at least one ionization needle as said ozone enters said core thereby cleaning contaminants from said needles.

9. An air ionization system according to claim 1, said system further comprising:

at least one pair of opposed slots formed in said core between said plurality of opposed pairs of ionization needle assemblies; and at least one percentage divider plate adapted to be removably received by said at least one pair of opposed slots for isolating said first number of said opposed pairs of ionization needle assemblies from said second number of said opposed pairs of ionization needle assemblies.

10. An air ionization system according to claim 1 wherein at least one of said ionization needle assemblies comprises at least one removably replaceable ionization needle in electrical connection with an output of said ionization unit.

11. An air ionization system according to claim 10 wherein said at least one of said ionization needle assemblies comprises:

an insulating base section;

a wire inserted into a bottom of said base section, a conductor of said wire being in electrical connection with said output of said ionization unit; and a connector clip electrically fastened to said conductor of said wire, said at least one ionization needle being removably inserted into said connector clip and extending axially outward from said base section.

12. An air ionization system according to claim 1, said system further comprising at least one purging hose connected to a compressed air source, said purging hose extending into said core and being adapted to move within said core when compressed air is forced through said purging hose to thereby clean contaminants from an interior surface of said core.

13. An air ionization system according to claim 1, wherein said ozone generation unit comprises a rectifier for creating said high voltage output from said alternating current input.

14. An air ionization system according to claim 13, wherein said rectifier is a half-wave bridge rectifier.

15. An air ionization system according to claim 1, wherein said ozone generation unit further comprises an ozone cartridge having at least one set of opposed slots for removably receiving said at least one ozone generation plate.

16. An air ionization system according to claim 15 wherein said ozone generation cartridge further comprises a terminal for electrically connecting said at least one ozone generation plate with an output of said ozone generation unit.

17. An air ionization system according to claim 15 wherein said ozone cartridge further comprises a projection for receiving a connector attached to said ozone generation plate to thereby removably fix said ozone generation plate within said cartridge.

18. An air ionization system according to claim 1, said second number is greater than said first number.

19. An air ionization system according to claim 1, wherein said second number comprises at least 80% of said plurality of opposed pairs of ionization needle assemblies.

* * * * *